US006179282B1

(12) United States Patent
Ahn

(10) Patent No.: US 6,179,282 B1
(45) Date of Patent: Jan. 30, 2001

(54) APPARATUS AND METHOD FOR SUPPLYING PAPER IN PRINTER

(75) Inventor: Hee-mun Ahn, Suwon (KR)

(73) Assignee: Samsung Electronics Co., Ltd., Kyungki-do (KR)

( * ) Notice: Under 35 U.S.C. 154(b), the term of this patent shall be extended for 0 days.

(21) Appl. No.: 09/336,721

(22) Filed: Jun. 21, 1999

(30) Foreign Application Priority Data

Jun. 22, 1998 (KR) ..... 98-23472

(51) Int. Cl.[7] ..... B65H 3/06
(52) U.S. Cl. ..... 271/114; 271/118
(58) Field of Search ..... 271/114, 115, 271/116, 118

(56) References Cited

U.S. PATENT DOCUMENTS 4,934,686 * 6/1990 Ono et al. ..... 271/118
5,624,109 * 4/1997 Tanaka ..... 271/118
5,755,435 * 5/1998 Fujiwara ..... 271/118

FOREIGN PATENT DOCUMENTS

002664247A * 1/1992 (FR) ..... 271/114
0011438 * 1/1983 (JP) ..... 271/116
3-177239 8/1991 (JP) ..... B65H/3/06
404094334A * 3/1992 (JP) ..... 271/114
10-120200 5/1998 (JP) ..... B65H/1/24

* cited by examiner

*Primary Examiner*—H. Grant Skaggs
(74) *Attorney, Agent, or Firm*—Sughrue, Mion, Zinn, Macpeak & Seas, PLLC

(57) ABSTRACT

A paper supplying apparatus in a printer and method for supplying paper loaded in a cassette to a printing unit in a printer main body, the apparatus including a pickup roller pivotally installed on the printer main body so as to be closely in contact with the paper, for picking up the paper while rotating in contact with the paper, mechanism for pivoting and rotating the pickup roller installed on the printer main body, and a rotation delay mechanism for delaying the initial rotation of the pickup roller for a predetermined time. Similarly, the paper supplying method includes the steps of pivotally installing a pickup roller on the printer main body so as to be closely in contact with the paper, for picking up the paper while rotating in contact with the paper, pivoting and rotating the pickup roller installed on the printer main body, and delaying the initial rotation of the pickup roller for a predetermined time.

11 Claims, 5 Drawing Sheets

APPARATUS AND METHOD FOR SUPPLYING PAPER IN PRINTER

BACKGROUND OF THE INVENTION

1. Field of the Invention

The present invention relates to an apparatus and method, for supplying paper in a printer, and more particularly, to an apparatus and method, for supplying paper in a printer having an improved structure for supplying sheets of paper placed in a cassette to a printing unit in the printer.

2. Description of the Related Art

A general device such as a printer or a photocopier includes a paper supplying apparatus for receiving a plurality of sheets of paper and sequentially supplying the received sheets of paper to a printing unit of the device.

A paper supplying apparatus in a conventional printer, as shown in FIG. 1, includes a cassette 20 and a pickup roller 13. The cassette 20 is attachable and detachable along guide rails 12 and 14 provided in a printer main body 10, and receives paper. The pickup roller 13 is rotatably installed within the printer main body 10 and is closely in contact with the leading end of paper placed in the cassette 20.

As shown in FIG. 2, when paper 1 loaded in the cassette 20 is supplied to a printing unit (not shown), the pickup roller 13 supplies the paper 1 in close contact with the pickup roller is in the direction indicated by arrow B while descending by a pivoting means (not shown) and simultaneously rotating by a rotating means (not shown). Here, since the corners 27 and 28, of the paper 1 are constrained respectively by finger members 25 and 26, a leading end C of the paper 1 is raised, as indicated by a dotted line in FIG. 2. Thus, the paper 1 is separated from the other sheets of paper below the paper 1 and supplied to the printing unit.

However, in the conventional paper supplying apparatus having such a configuration, the pickup roller 13 rotates and pivots at the same time, and thus may not be horizontally in contact with the paper 1 during pivoting. At this time, a portion of the leading end C of the paper 1 previously in contact with the pickup roller 13 proceed, before the other portion of the leading end C of the paper 1, thereby skewly supplying paper to the printing unit.

SUMMARY OF THE INVENTION

To solve the above problem, it is an objective of the present invention to provide a paper supplying apparatus and method, for a printer having an improved structure delays the rotation of a pickup roller until the pickup roller is completely in contact with a sheet of paper.

Accordingly, to achieve the above objective, there is provided a paper supplying apparatus and method, in a printer for supplying paper loaded in a cassette to a printing unit in a printer main body, the apparatus comprising: a pickup roller pivotally installed on the printer main body so as to be closely in contact with the paper, for picking up the paper while rotating in contact with the paper; means for pivoting and rotating the pickup roller installed on the printer main body; and a rotation delay means for delaying the initial rotation of the pickup roller for a predetermined time.

The pivoting/rotating means comprises: a first gear member rotatably installed on the printer main body; a shaft with which the pickup roller is slidably combined, the shaft being movably coupled to the printer main body; and a second gear member which pivots in engagement with and with respect to the first gear member together with the shaft and is installed on the shaft so as to transmit the rotating force of the first gear member to the shaft.

The rotation delay means comprises: a protrusion formed on the side surface of the second gear member; and a guide groove formed in a predetermined shape on the side surface of the pickup roller so that the protrusion can slide during the initial rotation of the first gear member, and the rotating force of the second gear member can be transmitted to the pickup roller by the protrusion contacting the leading end of the guide groove.

Alternatively, the rotation delay may comprise: a protrusion formed on the side surface of the pickup roller; and a guide groove formed in a predetermined shape on the side surface of the second gear member so that the protrusion can slide during the initial rotation of the first gear member, and the rotating force of the second gear member can be transmitted to the pickup roller by the protrusion contacting the leading end of the guide groove.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENT

Figure 1:
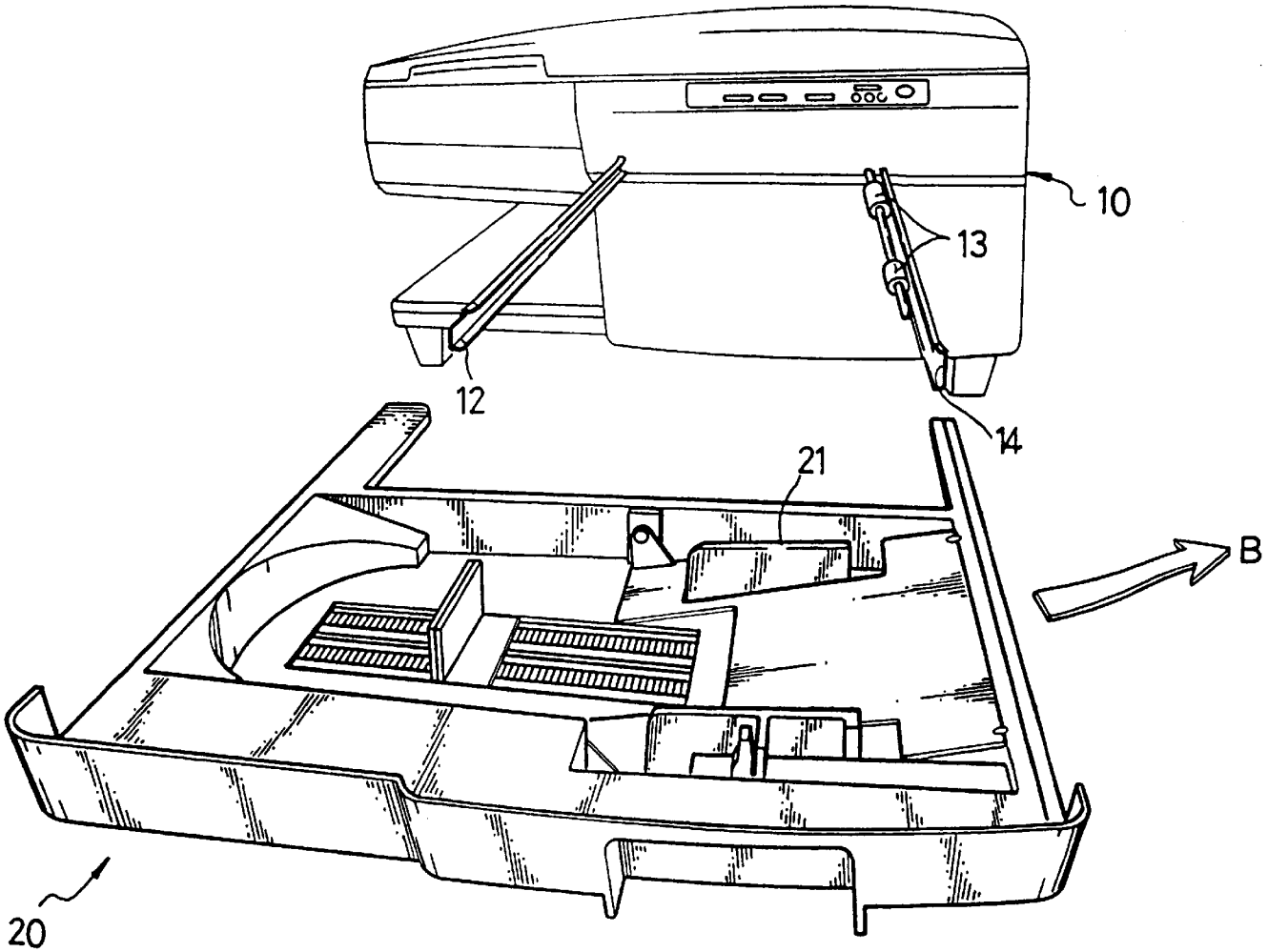
FIG. 1 (PRIOR ART)
FIG. 1 is a perspective view illustrating a paper supplying apparatus in a conventional printer.
Figure 2:
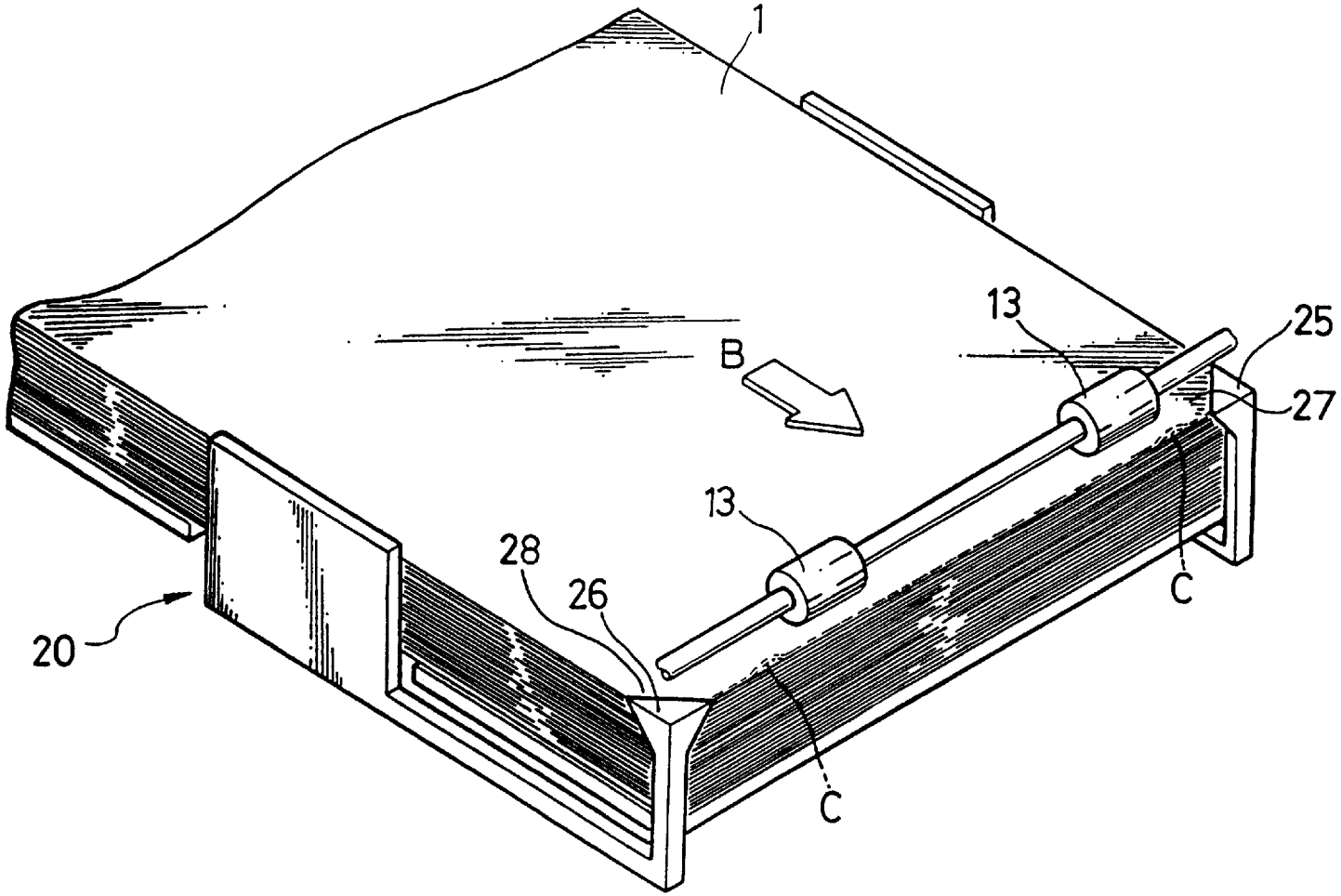
FIG. 2 (PRIOR ART)
FIG. 2 is a perspective view illustrating the supplying operation of the paper supplying apparatus shown in FIG. 1.
Figure 3:
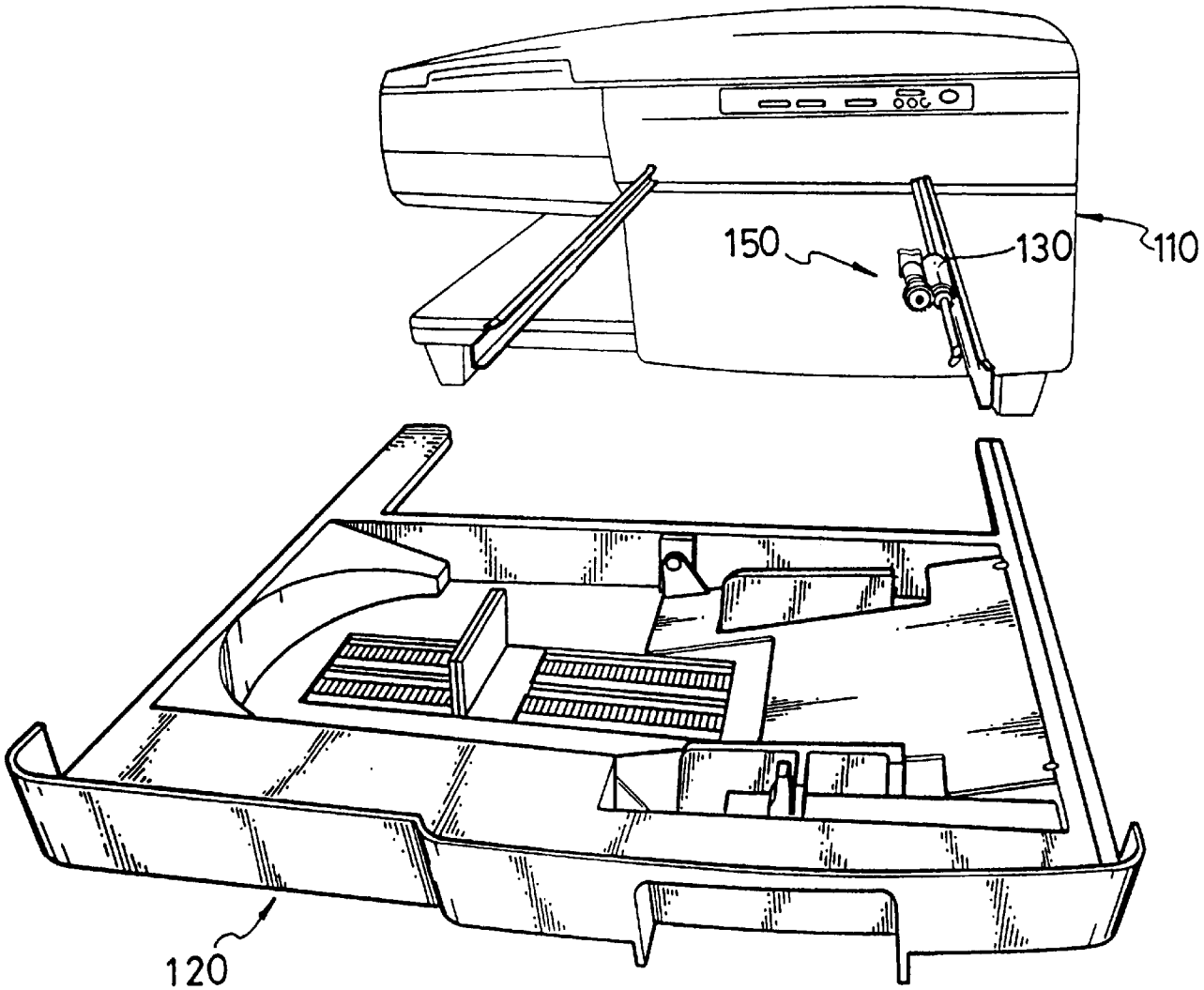
FIG. 3 is a perspective view illustrating a paper supplying apparatus in a printer according to an embodiment of the present invention.

Referring to FIG. 3, a paper supplying apparatus according to a preferred embodiment of the present invention includes a cassette 120 attachable and detachable to and from a printer main body 110, a pickup roller 130 for supplying paper (not shown) loaded in the cassette 120 to a printing unit (not shown) in the printer main body 110, a pivoting/rotating means 150 for pivoting and rotating the pickup roller 130, and a rotation delay means 170 (not shown in FIG. 3) for delaying the initial rotation of the pickup roller 130 for a predetermined time.

Figure 4:
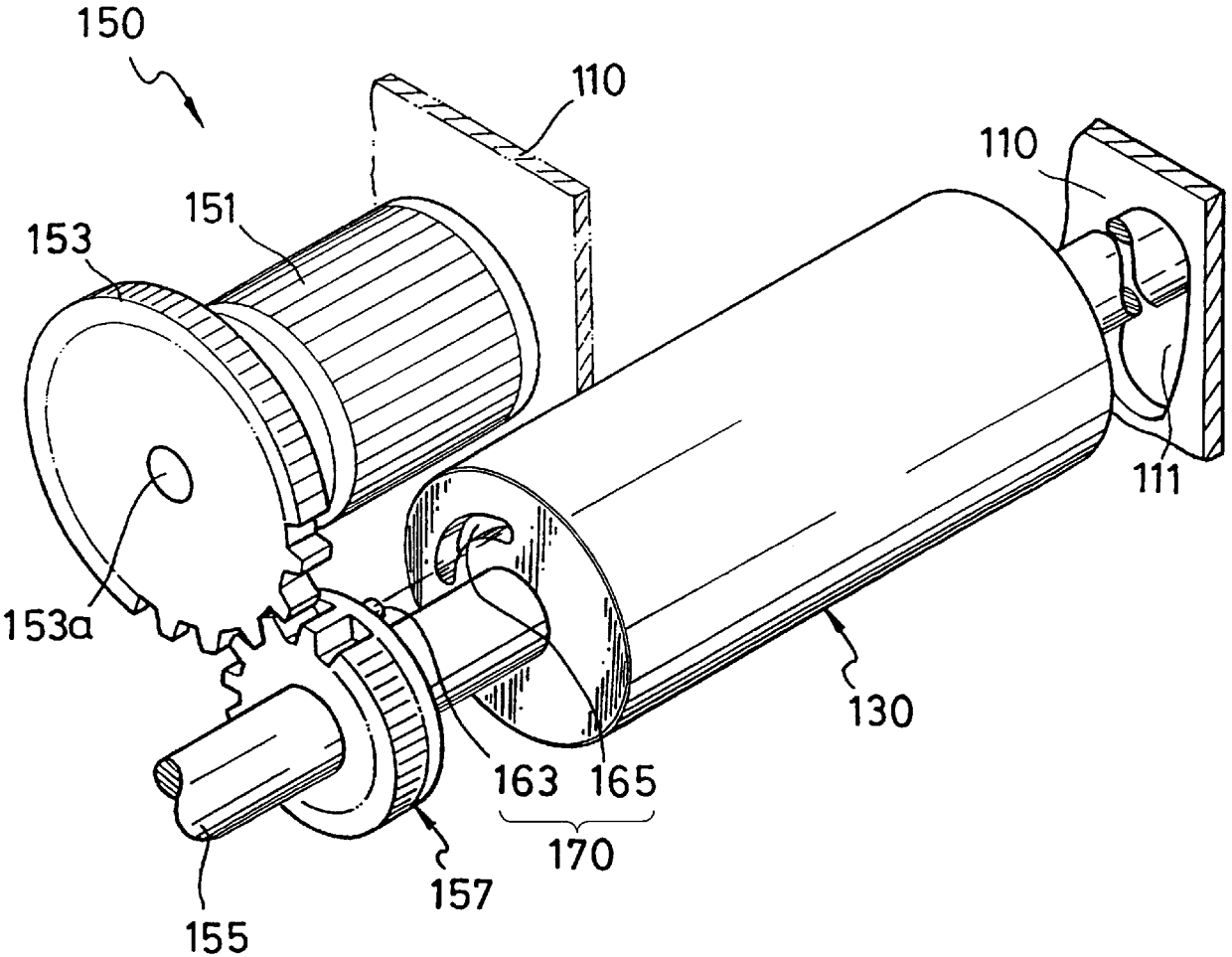
FIG. 4 is an enlarged view of the main parts of FIG. 3.

The pivoting/rotating means 150, as shown in FIG. 4, includes a driving source 151 installed on the printer main body 110, a first gear member 153 installed around a rotation shaft 153a of the driving source 151, a shaft 155 being around which the pickup roller 130 is slidably combined, the shaft 155 movably combined with the printer main body 110, and a second gear member 157 engaged with the first gear member 153 and coaxially installed around the shaft 155. Here, the driving source 151 is a typical electrical motor which can rotate normally and in reverse.

The shaft 155 is slidably inserted into a pivot slot 111 formed in a predetermined shape in the printer main body 110. The second gear member 157 transmits the rotating force of the first gear member 153 to the shaft 155. Thus, the second gear member 157 and the pickup roller 130 pivot within a predetermined angle together with the shaft 155 sliding along the pivot slot 111, with respect to the rotation shaft 153a of the first gear member 153. Here, the pivoting angle of the shaft 155 corresponds to an angle at which the pickup roller 130 isolated from the cassette 120 is closely in contact with the paper loaded on the cassette 120.

The rotation delay means 170 comprises comprised of a protrusion 163 formed on the side surface of the second gear member 157 and a guide groove 165 formed on the side surface of the pickup roller 130 opposite to the protrusion 163. The guide groove 165 has a predetermined shape so that the protrusion 163 can slide a predetermined distance during the initial rotation of the first gear member 153, and that the rotating force of the second gear member 157 can be transmitted to the pickup roller 130 due to contact of the protrusion 163 with the leading end of the guide groove 165. It is preferable that the guide groove 165 is slightly larger than the pivoting angle of the second gear member 157 and the shaft 155 with respect to the first gear member 153. Alternatively, the protrusion 163 can be formed on the pickup roller 130, and the guide groove 165 can be formed on the second gear member 157.

Figure 5A:
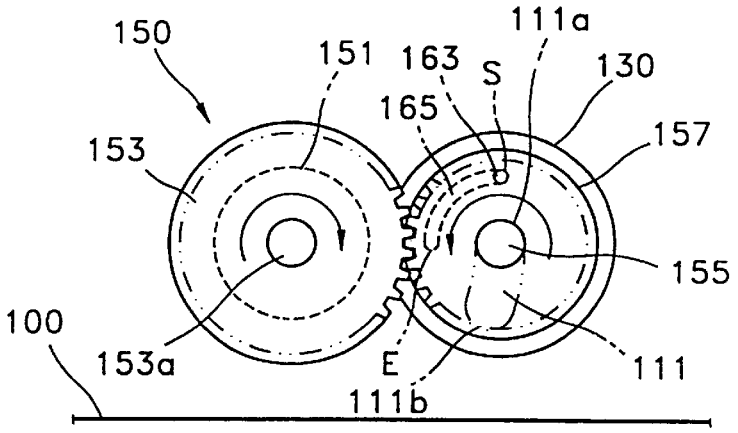
FIGS. 5A through 5C are side views illustrating the paper supplying method of the operation of a paper supplying apparatus according to the present invention.

In the paper supplying apparatus and method in a printer as described above, when the paper is not supplied to the printing unit, the pickup roller 130 is isolated from a paper 100 loaded in the cassette 120 as shown in FIG. 5A. Here, the protrusion 163 is placed on one end (S) of the guide groove 165, and the shaft 155 is positioned on one end 111*a* of the pivot slot 111.

Figure 5B:
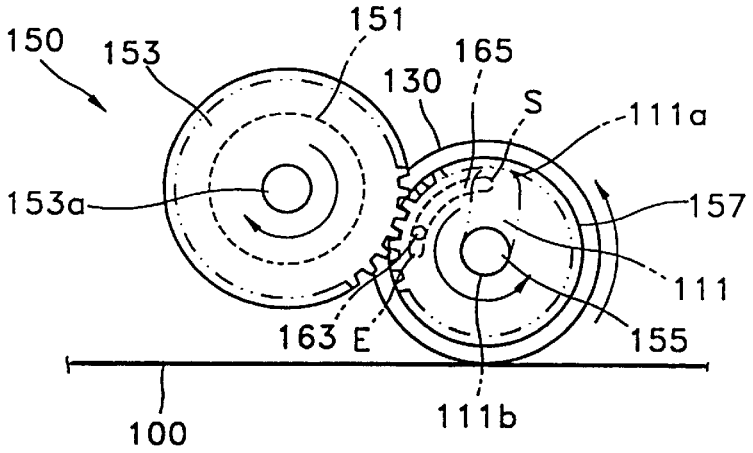

When the first gear member 153 is rotated by driving the driving source 151 to supply the paper 100 to the printing unit, the shaft 155 slides along the pivot slot 111. Accordingly, the shaft 155 contacts the other end 111*b* of the pivot slot 111 as shown in FIG. 5B. Thus, the pickup roller 130 is closely in contact with the paper 100.

Figure 5C:
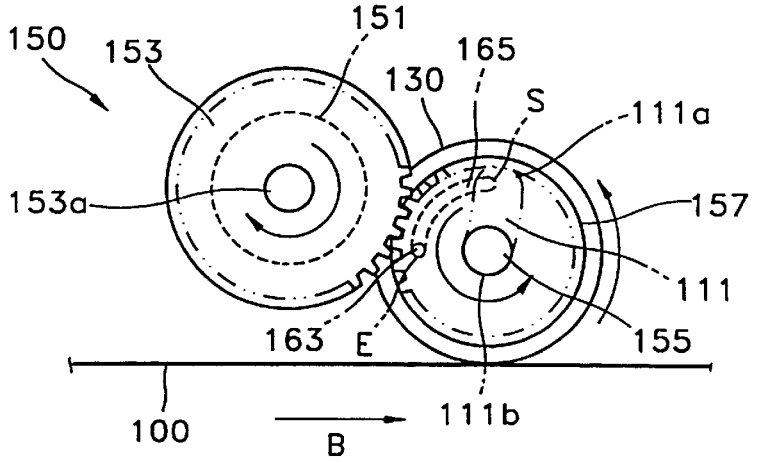

Then, when the second gear member 157 meshed with the first gear member 153 continuously rotates, the rotation of the pickup roller 130 is delayed until the protrusion 163 slides along the guide groove 165 and contacts the other side E of the guide groove 165 as shown in FIG. 5C. The pickup roller 130 is evenly in contact with the paper 100 for the delay time.

In this state, when the driving source 151 is continuously driven, the rotating force of the driving source 151 is transmitted to the pickup roller 130 by the protrusion 163 and the guide groove 165. Thus, the paper 100 closely contacting the pickup roller 130 can be supplied to the printing unit.

After the supplying operation is concluded, the pickup roller 130 is restored to its original position by driving the driving source 151 in a reverse direction.

Thus the paper supplying apparatus in a printer according to the present invention delays the rotation of the pickup roller so that the pickup roller can rotate a predetermined time after the pickup roller has made contact with the paper. Therefore, the pickup roller can be equally in contact with the paper before its rotation, which prevents skewing that is likely to be generated during proceeding of paper.

Although particular embodiments of the present invention have been shown and described, it is contemplated that numerous modifications may be made without departing from the spirit and scope of the invention as defined in the claims.

What is claimed is:

1. A paper supplying apparatus in a printer for supplying paper loaded in a cassette to a printing unit in a printer main body, the apparatus comprising:

a pickup roller having a side surface, said pickup roller being pivotally installed on the printer main body so as to be closely in contact with the paper, for picking up the paper while rotating in contact with the paper;

means for pivoting and rotating the pickup roller installed on the printer main body; and a rotation delay means for delaying an initial rotation of the pickup roller for a predetermined time;

wherein the pivoting/rotating means includes:

a first gear member rotatably installed on the printer main body:

a first shaft with which the pickup roller is slidably combined, the first shaft being movably coupled to the printer main body; and a second gear member having a side surface, said second gear member which pivots in engagement with and with respect to the first gear member and is installed on the first shaft so as to transmit a rotating force of the first gear member to the first shaft.

2. The paper supplying apparatus in a printer as claimed in claim 1, wherein the rotation delay means comprises:

a protrusion formed on the side surface of the second gear member; and a guide groove having a leading end said guide groove being formed in a predetermined shape on the side surface of the pickup roller so that the protrusion can slide during an initial rotation of the first gear member, and the rotating force of the second gear member can be transmitted to the pickup roller by the protrusion contacting the leading end of the guide groove.

3. The paper supplying apparatus in a printer as claimed in claim 1, wherein the rotation delay means comprises:

a protrusion formed on the side surface of the pickup roller; and a guide groove having a leading end, said guide groove being formed in a predetermined shape on the side surface of the second gear member so that the protrusion can slide during an initial rotation of the first gear member, and the rotating force of the second gear member can be transmitted to the pickup roller by the protrusion contacting the leading end of the guide groove.

4. The paper supplying apparatus in a printer, as claimed in claim 1, wherein said first gear member is installed on a rotatable second shaft, the second shaft being disposed along an axis of a driving source installed on the printer main body.

5. The paper supplying apparatus in a printer, as claimed in claim 4, wherein the shaft is installed along an axis of a driving source installed on the printer main body.

6. A method for supplying paper loaded in a cassette to a printing unit in a printer main body comprising the steps of:

pivotally installing a pickup roller on a shaft connected to the printer main body such that said pickup roller is slidably combined with the shaft and the shaft is movably coupled to the printer main body, and such that said pickup roller is closely in contact with the paper, to pick up the paper while rotating in contact with the paper;

rotating a first gear member installed on the printer main body, to pivot the shaft via a second gear member installed on the shaft, such that said first gear member transmits a rotating force to the shaft via its engagement with said second gear member;

pivoting and rotating the pickup roller due to the rotation of said shaft; and delaying an initial rotation of the pickup roller for a predetermined time.

7. The method for supplying paper as claimed in claim 6 wherein the delaying of an initial rotation is provided by a delay means which comprises:

a protrusion formed on the side surface of the second gear member; and a guide groove formed in a predetermined shape on the side surface of the pickup roller so that the protrusion can slide during an initial rotation of the first gear member, and the rotating force of the second gear member can be transmitted to the pickup roller by the protrusion contacting a leading end of the guide groove.

8. The method for supplying paper as claimed in claim 6 wherein the delaying of an initial rotation is provided by a delay means which comprises:

a protrusion formed on the side surface of the pickup roller; and a guide groove formed in a predetermined shape on the side surface of the second gear member so that the protrusion can slide during an initial rotation of the first gear member, and the rotating force of the second gear member can be transmitted to the pickup roller by the protrusion contacting a leading end of the guide groove.

9. A paper supplying apparatus in a printer for supplying paper loaded in a cassette to a printing unit in a printer main body, the apparatus comprising:

a pickup roller having a side surface, said pickup roller being pivotally installed on the printer main body so as to be closely in contact with the paper, for picking up the paper while rotating in contact with the paper;

a mechanism for pivoting and rotating the pickup roller installed on the printer main body; and a rotation delay mechanism for delaying an initial rotation of the pickup roller for a predetermined time;

wherein the pivoting/rotating mechanism includes:

a first gear member rotatable installed on the printer main body;

a shaft with which the pickup roller is slidably combined, the shaft being movably coupled to the printer main body; and a second gear member having a side surface, said second gear member which pivots in engagement with and with respect to the first gear member and is installed on the shaft so as to transmit a rotating force of the first gear member to the shaft.

10. The paper supplying apparatus in a printer as claimed in claim 9, wherein the rotation delay means comprises:

a protrusion formed on the side surface of the second gear member; and a guide groove formed in a predetermined shape on the side surface of the pickup roller so that the protrusion can slide during an initial rotation of the first gear member, and the rotating force of the second gear member can be transmitted to the pickup roller by the protrusion contacting a leading end of the guide groove.

11. The paper supplying apparatus in a printer as claimed in claim 9, wherein the rotation delay means comprises:

a protrusion formed on the side surface of the pickup roller; and a guide groove formed in a predetermined shape on the side surface of the second gear member so that the protrusion can slide during an initial rotation of the first gear member, and the rotating force of the second gear member can be transmitted to the pickup roller by the protrusion contacting a leading end of the guide groove.

* * * * *